US009939168B2

(12) United States Patent
Krishnasamy et al.

(10) Patent No.: US 9,939,168 B2
(45) Date of Patent: Apr. 10, 2018

(54) VARIABLE AIRFLOW VOLUME BALANCING USING A VARIABLE AIRFLOW VOLUME CONTROLLER

(71) Applicant: Honeywell International Inc., Morristown, NJ (US)

(72) Inventors: Balaji Krishnasamy, Madurai (IN); Deenadayalan Karunakaran, Bangalore (IN)

(73) Assignee: Honeywell International Inc., Morris Plains, NJ (US)

( * ) Notice: Subject to any disclaimer, the term of this patent is extended or adjusted under 35 U.S.C. 154(b) by 504 days.

(21) Appl. No.: 14/527,888

(22) Filed: Oct. 30, 2014

(65) Prior Publication Data

US 2016/0123614 A1 May 5, 2016

(51) Int. Cl.
*F24F 11/04* (2006.01)
*F24F 11/00* (2018.01)

(52) U.S. Cl.
CPC ..... *F24F 11/04* (2013.01); *F24F 11/006* (2013.01); *F24F 2011/0068* (2013.01)

(58) Field of Classification Search
CPC . F24F 11/04; F24F 2011/0067; Y02B 30/767; Y02B 70/3216; Y02B 70/3241; Y02B 70/3275; Y02B 90/2684; Y04S 10/30; Y04S 20/221; Y04S 20/227; Y04S 20/244; Y04S 40/143
See application file for complete search history.

(56) References Cited

U.S. PATENT DOCUMENTS 5,341,988 A * 8/1994 Rein ..... G05D 23/1934 236/49.3
5,535,814 A * 7/1996 Hartman ..... F24F 11/0009 165/217
5,605,280 A * 2/1997 Hartman ..... F24F 11/0009 165/209
5,725,148 A * 3/1998 Hartman ..... F24F 3/044 165/217
7,653,459 B2 * 1/2010 Pouchak ..... F24F 3/0442 700/276
7,891,573 B2 * 2/2011 Finkam ..... F24F 11/001 236/1 C
8,939,827 B2 * 1/2015 Boudreau ..... F24F 12/006 236/44 C
9,441,848 B2 * 9/2016 Meruva ..... F24F 11/006
2007/0082601 A1 * 4/2007 Desrochers ..... F24F 3/044 454/256
2008/0277486 A1 * 11/2008 Seem ..... F24F 11/0009 236/49.3

(Continued)

FOREIGN PATENT DOCUMENTS

JP 03229954 A * 10/1991

*Primary Examiner* — Crystal J Barnes-Bullock
(74) *Attorney, Agent, or Firm* — Brooks, Cameron & Huebsch, PLLC

(57) ABSTRACT

Variable airflow volume balancing using a variable airflow volume controller is described herein. One method includes receiving, by a variable airflow volume controller, a command from a computing device to begin variable airflow volume balancing. The method can include performing a balancing function using the variable airflow volume controller in response to the command, wherein the balancing function is performed independent of the computing device.

16 Claims, 4 Drawing Sheets

(56) References Cited

U.S. PATENT DOCUMENTS

| | | | | |
|---|---|---|---|---|
| 2011/0303406 | A1* | 12/2011 | Takeda | H05K 7/20836 165/288 |
| 2013/0304259 | A1 | 11/2013 | Meruva et al. | |

* cited by examiner

VARIABLE AIRFLOW VOLUME BALANCING USING A VARIABLE AIRFLOW VOLUME CONTROLLER

TECHNICAL FIELD

The present disclosure relates to variable airflow volume balancing using a variable airflow volume controller.

BACKGROUND

Variable airflow volume (VAV) systems can be used in commercial structures such as shopping malls, airports, stadiums, and office buildings. In contrast to some heating, ventilation, and cooling systems, VAV systems can change the volume of air that is passed through duct work instead of changing the temperature of the air. VAV balancing can be performed to calibrate parameters associated with the VAV system, which can help to ensure that a VAV system works efficiently and provides acceptable air quality.

VAV systems can employ a plurality (e.g., thousands) of VAV boxes, which can control the volume of air that is introduced into a space. VAV balancing can be performed on each VAV box, which can include opening and closing the damper in the VAV box, for example. Because a plurality of VAV boxes can be located in a structure, the time associated with balancing all VAV boxes in the structure can be substantial.

DETAILED DESCRIPTION

Figure 1:
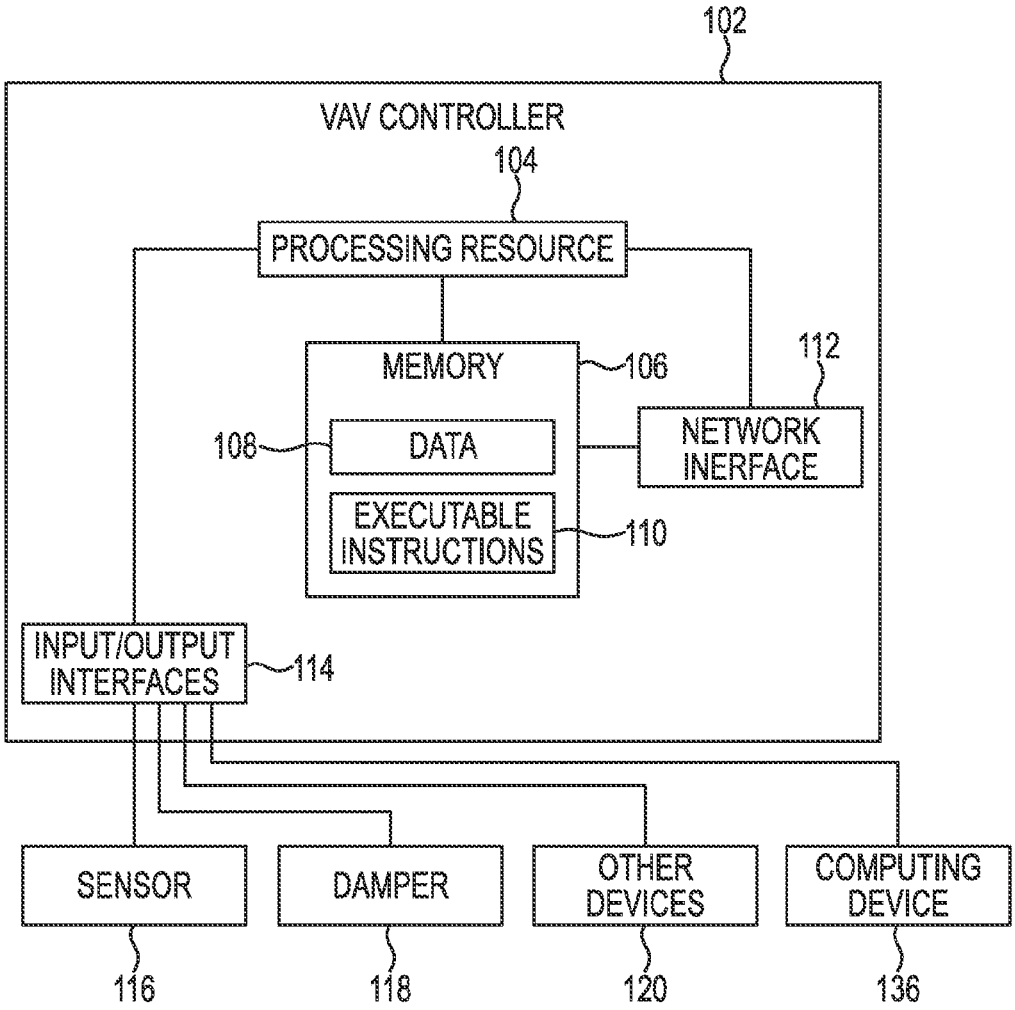
FIG. 1 illustrates a VAV controller in accordance with one or more embodiments of the present disclosure.

Variable airflow volume balancing using a variable airflow volume controller is described herein. For example, one or more embodiments can include receiving, by a VAV controller, a command from a computing device to begin VAV balancing. The method can include performing a balancing function using the VAV controller in response to the command, wherein the balancing function is performed independent of the computing device.

VAV systems, as previously discussed, can employ a plurality of VAV boxes, which can control the volume of air that is introduced into a space. For example, duct work can feed into an inlet of the VAV box and can pass through an outlet of the VAV box. The air passed through the outlet can be directed into vents that supply air into the space. The VAV box can control the volume of air that passes through the VAV box, for example. The damper can be controlled by a VAV controller that is in communication with a drive motor of the damper.

VAV balancing can include preparation of a VAV controller of a VAV box to approximately control an intended volume of airflow. VAV balancing can be performed on each VAV box. This can ensure that the VAV box is operating properly and to ensure that the space is heated and/or cooled efficiently and air quality is maintained. Because a plurality of VAV boxes can be located in a structure, the time associated with balancing VAV boxes in the structure can be substantial. For example, a damper time associated with rotating a damper can be several minutes. Thereby, a speed at which each VAV box is balanced can be limited by the damper time.

Prior approaches for VAV balancing can include establishing and maintaining a communication connection to a VAV controller using a computing device that is performing the VAV balancing. For example, calibrated instruments can be used to measure airflow (e.g., an actual air volume of airflow) through the VAV box. The device performing the VAV balancing can send feedback to the VAV controller that includes the error ratio of measured airflow to the value the VAV controller reports as sensed airflow. Subsequently, the VAV controller can use the error ratio to calculate sensed airflow within a threshold accuracy.

Establishing and maintaining a communication connection with a VAV controller can be difficult. Many VAV controllers are installed in a low bandwidth network, such as a building automation and control network (BACnet)/master-slave/token-passing (MSTP). A low bandwidth network can result in unreliable communication. Maintaining a communication connection with a computing device that is running the balancing software and the VAV controllers through an intermediate router can increase reliability; however, the communication connection performance is limited by the routing performance of the intermediate router. Because of the unreliable network communication, the VAV balancing process can be interrupted, resulting in increased performance time, increased user frustration, and/or increased user confusion.

In contrast, embodiments in accordance with the present disclosure can include methods, systems, and devices for VAV balancing that is performed using a balancing function independently in the VAV controller. For example, the balancing function can be preprogrammed in the VAV controller and/or downloaded from a computing device. The VAV controller can perform VAV balancing using the balancing function in response to a command to begin VAV balancing from a computing device that is performing balancing instructions (e.g., balancing software). Once the command is received, the VAV balancing can be performed by the VAV controller without a communication connection with the computing device. That is, the VAV controller can independently perform VAV balancing in response to the command from the computing device.

By performing VAV balancing independently in the VAV controller, embodiments in accordance with the present disclosure can reduce the amount of time to balance VAVs in a structure. For example, VAV balancing can be performed without maintaining a constant communication connection between the individual VAV controllers in the structure and a computing device performing balancing instructions. That is, the independent performance in the VAV controller can reduce loss in productivity as the balancing process may not be interrupted by loss of a communication connection.

In addition, in accordance with number of embodiments, the balancing function performed by the VAV controller can reduce a number of errors in the VAV balancing process as compared to prior balancing functions. For example, the balancing function can be based on a proximity of a current sensed airflow to an airflow set point and an elapsed time of the balancing function. The balancing function can minimize the damper movement based on the proximity of the current sensed airflow to the airflow set point. Further, the balancing function can make use of the elapsed time of the balancing function to avoid overshooting the set point. Such a balancing function can, for example, use a single filter that may exhibit less delay and faster converge time than prior balancing functions.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in some embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 136 may reference element "36" in FIG. 1, and a similar element may be reference by 236 in FIG. 2.

As used herein, "a" or "a number of" refers to one or more. For example, "a number of routers" can refer to one or more routers. Additionally, the designator "N" and "P" as used herein, particularly with respect to reference numerals in the drawings, indicates that a number of the particular feature so designated can be included with embodiments of the present disclosure.

FIG. 1 illustrates a VAV controller in accordance with one or more embodiments of the present disclosure. The VAV controller 102, as described herein, can perform VAV balancing using a balancing function independently of another device (e.g., independent of a communication connection with another device).

As shown in FIG. 1, the VAV controller 102 can include a computing component. The computing component can include a memory 106 and a processing resource 104 coupled to the memory 106. The memory 106 can be any type of storage medium that can be accessed by the processor 104 to perform various examples of the present disclosure. For example, the memory 106 can be a non-transitory computer readable medium having computer readable instructions (e.g., computer program instructions) stored thereon that are executable by the processing resource 104 to perform various examples of the present disclosure.

The memory 106 can be volatile or nonvolatile memory 106. The memory 106 can also be removable (e.g., portable) memory, or non-removable (e.g., internal) memory. For example, the memory 106 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory. Further, the memory 106 can be located in the computing component, or internal to another computing component (e.g., enabling computer readable instructions to be downloaded over the Internet or another wired or wireless connection).

The memory 106 can include instructions 110 executable by the processing resource 104 to cause the VAV controller 102 to perform a number of functions. For example, the processing resource 104, in association with the memory 106, can store and/or utilize data 108 and/or execute instructions 110 to perform VAV balancing.

Such data 108 can include current and/or past sensed airflow (e.g., sensed airflow data), one or more airflow set points, a start time of the balancing function, an elapsed time, a current balancing state, and/or a balancing function. Such executable instructions 110 can include instructions for performing VAV balancing.

As illustrated in the embodiment of FIG. 1, the VAV controller 102 can include one or more input and/or output interfaces 114. Such interfaces can be used to connect the VAV controller 102 with one or more input or output devices.

For example, the VAV controller 102 can be connected to (e.g., in communication) with one or more sensors 116, a damper 118, a computing device 136, and/or other devices 120 (e.g., other VAV controllers) via a communication connection. The communication connection, in some embodiments, can include a wireless and/or wired communication. For instance, the communication connection can be such that the VAV controller 102 is remote from the sensor 116, the damper 118, the computing device 136, and/or other devices 120 such as in a network relationship between the VAV controller 102, and the sensor 116, the damper 118, the computing device 136, and/or other devices 120. That is, the communication connection can be a network relationship. Examples of such a network relationship can include a home network, a heating, ventilation, and cooling (HVAC) network, a local area network (LAN), a wide area network (WAN), a personal area network (PAN), and the Internet, among others.

A sensor, as used herein, can include any suitable device that measures and/or takes a physical quantity. For example, the sensor 116 can include an airflow sensor. An airflow sensor can measure a volume of air per period of time (e.g., airflow) of air entering the VAV box.

The damper can include a device in duct work that regulates airflow. The computing device 136 can include a mobile and/or stationary device that is performing (e.g., running) VAV balancing instructions, as discussed further herein.

As illustrated in the embodiment of FIG. 1, the VAV controller 102 can include a network interface 112. Such an interface can allow for processing on another networked computing device or such devices can be used to obtain information or executable instructions for use with various embodiments provided herein.

The VAV controller 102 can perform a number of VAV balancing actions. For example, the VAV controller 102 can receive from computing device 136 a command to begin VAV balancing, and perform a balancing function in response to the command. The VAV controller 102 can perform the balancing function independent of the computing device 136 (e.g., can be performed independently by the VAV controller 102). For example the VAV controller 102 can be disconnected from the computing device 136 during performance of the balancing function.

The command can include a balancing command for one or more VAV controllers to begin VAV balancing. The command can be sent as a signal from the computing device 136 and can be received by the VAV controller 102.

In some embodiments, the signal can include a command from the computing device 136 for a subset of a plurality of VAV controllers in a structure to begin VAV balancing. The signal can specify which VAV controllers the user has selected for the command to be sent.

The balancing function can compare measured airflow to current sensed airflow. For example, the balancing function can be based on a proximity of a current sensed airflow to an airflow set point and an elapsed time of the balancing function (e.g., the VAV balancing). The balancing function can include an algorithm to minimize damper movement based on a proximity of the current sensed airflow to the airflow set point. Further, the balancing function can make use of the elapsed time of the balancing function to avoid overshooting the airflow set point, as discussed further in connection with FIG. 4.

As previously discussed, the VAV controller 102 can include the balancing function stored thereon. The balancing function can be firmware installed on the VAV controller 102. Alternatively, the balancing function can be received by the VAV controller 102 from a different device, such as the computing device. As an example, the computing device 136 can send the balancing function as a portion of the command to begin VAV balancing, which can be received by the VAV controller 102.

Prior to and/or in response to the command, an airflow set point can be received by the VAV controller 102 from the computing device 136. An airflow set point can include a particular volume of airflow per period of time (e.g., cubic feet per minute). In some embodiments, a plurality of airflow set points can be used.

In some embodiments, the VAV controller 102 and/or the computing device 136 can store a start time to begin performing the balancing function. The start time can be used to determine an elapsed time of the balancing function to prevent overshooting the airflow set point.

For example, the VAV controller 102 and/or the computing device 136 can include a counter. A counter, as used herein, can include software and/or hardware, but at least includes software, to track time. For instance, the counter can be used (e.g., started) to indicate an elapsed time of the balancing function.

In response to the counter reaching or exceeding a threshold elapsed time, the balancing function can end. For example, the VAV controller 102 can end the balancing function (and indicate a failure as the current balancing state) in response to reaching or exceeding the threshold elapsed time.

The VAV controller 102 can, in accordance with some embodiments, maintain a current balancing state of the VAV controller. A current balancing state of a VAV controller can include a status of the balancing function (of the VAV controller). The current balancing state can be maintained independent of the computing device 136 performing balancing instructions.

The VAV controller 102 can store the current balancing state. Example current balancing states can include "to be balanced", "reached set point", and/or "set point balancing". For example, the VAV controller 102 can store the current balancing state in response to reaching an airflow set point.

"To be balanced" can include a status of a VAV controller 102 that has not begun balancing. "Reached set point" can include a status of a VAV controller 102 that has reached the airflow set point. "Set point balancing" can include a status of a VAV controller 102 that is currently performing VAV balancing but has not reached the airflow set point.

By storing the current balancing state, the VAV controller 102 can restart performance of the balancing function in response to a power cycle affecting the VAV controller 102. For example, the VAV controller 102 can store a current balancing state. Upon a power loss and subsequent reconnection to power, the VAV controller 102 can restart the VAV balancing using the stored current balancing state.

The VAV controller 102, in accordance with the present disclosure, can send an indication to the computing device 136 of the current balancing state in response to connection of communication between the VAV controller 102 and the computing device 136. The indication can include a signal sent over the network, for example. That is, the computing device 136 can reconnect to the network to provide a communication connection to the VAV controller 102 and to check a status of VAV balancing of one or more VAV controllers.

In response to a current balancing state including an indication that the VAV controller 102 has reached the airflow set point, measured airflow data can be received from the computing device 136. Measured airflow data, as used herein, can include airflow of the VAV box that is measured with a calibrated instrument. For example, the computing device 136 can send a command (e.g., an additional command), to the VAV controller 102, to end VAV balancing in response to the indication that the airflow set point is reached.

If the VAV controller 102 includes a stable airflow, airflow of the VAV box can be measured with a calibrated instrument. For example, the computing device 136 can provide a visual or audio indication that the VAV controller 102 is balanced and has stable airflow. A user, in response, can measure airflow of the VAV box (e.g., actual airflow) and input the measured airflow data to the computing device 136 performing the balancing instructions. Inputting the measured airflow data can occur by the user typing the value using a keyboard of the computing device 136 and/or using voice commands.

The computing device 136 can send the measured airflow data to the VAV controller 102 and the VAV controller 102 can use the measured airflow data to complete VAV balancing. For instance, the VAV controller 102 can compare the measured airflow data to sensed airflow data to calibrate the VAV controller for VAV balancing.

Sensed airflow data, as used herein, can include current and/or past sensed airflow. Sensed airflow can include airflow values the VAV controller 102 reports (e.g., airflow as measured by the sensor of the VAV box associated with the VAV controller 102).

The calibration can include the error ratio of measured airflow to the sensed airflow (e.g., the airflow the VAV controller reports as sensed airflow). Subsequently, the VAV controller 102 can use the error ratio to calculate sensed airflow within a threshold accuracy.

Figure 2:
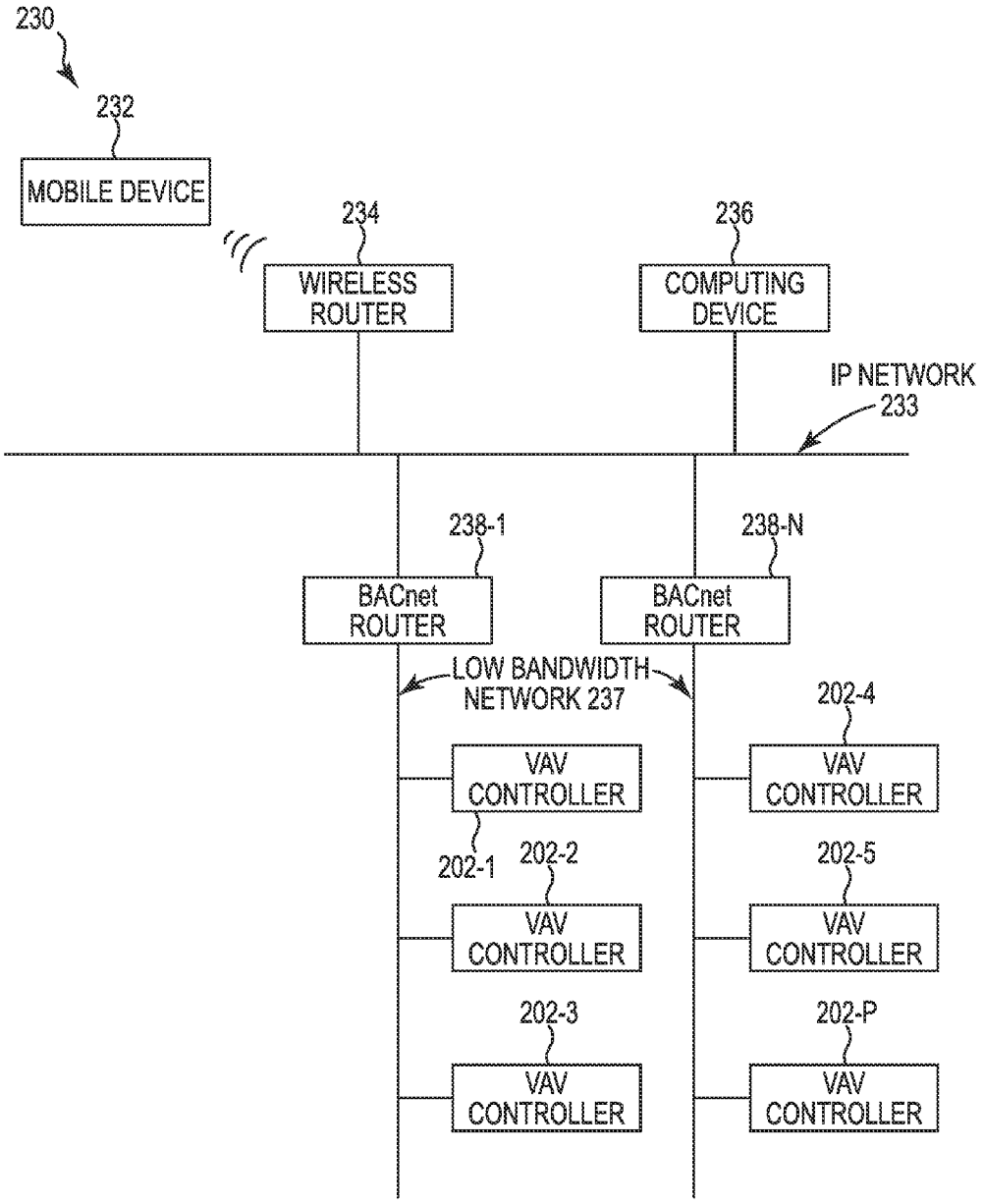
FIG. 2 illustrates an example of a VAV balancing system in accordance with one or more embodiments of the present disclosure.

FIG. 2 illustrates an example of a VAV balancing system in accordance with one or more embodiments of the present disclosure. The system 230 can receive, from a mobile device 232, a command to begin VAV balancing for one or more VAV controllers 202-1, 202-2, 202-3, 202-4, 202-5, 202-P (herein generally referred to as VAV controllers 202).

The VAV controllers 202 can be connected via a network. The network can be a low bandwidth network 237, such as a home network and/or a heating, ventilation, and cooling network and/or a BACnet/MSTP.

In some embodiments, the VAV controllers 202 can be in a plurality of zones. A zone can be a sub-portion of a structure. For example, multiple zones can exit as different hallways or rooms. In an example, VAV controllers 202-1, 202-2, and 202-3 can be in a first zone and VAV controllers 202-4, 202-5, 202-P can be in a second zone.

The VAV controllers 202 can be in communication with a number of routers. The routers can provide a communication interface between the VAV controllers 202 and the computing device 236. A router can include a networking device that forwards data packets between computer networks (e.g., between the IP network 233 and the low bandwidth network 237). That is, computing device 236 can communicate with VAV controllers 202 via the routers. As illustrated by FIG. 2, the routers can include building automation and control networks (BACnet) routers 238-1, 238-N (e.g., BACnet/IP to MSTP routers). That is, the number of routers can include at least one BACnet router connected to at least a subset of the plurality of VAV controllers 202.

In a number of embodiments, each zone can include a router to provide a communication interface for the respective VAV controllers within the zone. For example, a first BACnet router 238-1 can provide a communication interface for VAV controllers 202-1, 202-2, 202-3 in a first zone. A second BACnet router 238-N can provide a communication interface for VAV controllers 202-4, 202-5, 202-P in a second zone.

A command to begin VAV balancing can be sent by a mobile device 232. Mobile device 232 may be a cellular phone, a smart phone, a personal digital assistant (PDA), handheld computing device, etc. In an example, the mobile device 232 can be carried by a user that is performing VAV balancing on VAV controllers 202.

For example, as the user enters a zone, the user can prompt the mobile device 232 to complete a discovery process that locates the VAV controllers in the zone. Alternatively and/or, the user can enter the zone location into the mobile device 232 and in response the VAV controllers in the zone can be displayed.

The user, in a number of embodiments, can select a subset of the plurality of VAV controllers 232 to send a command to begin VAV balancing to. A command to begin VAV balancing is herein generally referred to as a balancing command. The user can then specify what balancing command to send to some and/or all of the VAV controllers 202.

In some embodiments, the system 230 can receive balancing commands from a single mobile device 232 in a zone. Alternatively and/or in addition, the system 230 can receive balancing commands from separate mobile devices in a zone or in separate zones.

As an example, a balancing command can be sent wirelessly from the mobile device 202 to a computing device 236. The balancing command can be received using a wireless router 234 as a signal. The computing device 236 can be performing VAV balancing instructions. That is, the computing device 236 and the mobile device 236 can communicate using an Internet Protocol (IP) network 233.

The VAV balancing instructions can include a program installed on the computing device 236 and associated with performing VAV balancing in a structure. A structure, as used herein, can include a shopping mall, an airport, a skyway system, a stadium, and an office building.

For example, the VAV balancing instructions can include instructions to determine a VAV balancing profile for each of the plurality of VAV controllers and/or for VAV controllers selected for VAV balancing. The VAV profile can be determined by searching a database (e.g., a VAV balancing profiles database) using information sent in the command.

A VAV balancing profile can include information related to the VAV box. For example, VAV controllers/boxes can be different models, have a balancing function as firmware, not have a balancing function as firmware, and/or other parameters (e.g., set points, units, etc.).

The computing device 236 can send the balancing command to the one or more VAV controllers 202. As previously discussed, the command can be sent to a subset of the VAV controllers 202 from the computing device 236. For example, the balancing command can be sent to VAV controllers 202-1, 202-2, 202-3 in a first zone. The command can be sent from the IP network 233 to the low bandwidth network 237 (e.g., BACnet/MSTP) using the low bandwidth routers (e.g., BACnet routers 238-1, 238-N).

In some embodiments, the balancing command can include the balancing function. For instance, one, a subset, or all of the VAV controllers 202 may have the balancing function stored as firmware. Alternatively and/or in addition, one, a subset, or all of the VAV controllers 202 may not have the balancing function. In such embodiments, the balancing function can be sent to the one or more VAV controllers 102 from the computing device 236. For example, the command to begin VAV balancing can include the balancing function.

Each of the plurality of VAV controllers 202 can receive a balancing command from the computing device 236 to begin VAV balancing and can perform a balancing function independent of the computing device 236. Independent of the computing device 236, as used herein, can include performing the balancing function whether or not a communication connection between the computing device 236 and the respective VAV controller exists. The balancing function can be performed in response to receiving the balancing command, for instance.

As previously discussed, each VAV controller 202 can maintain and/or store a current balancing state of the VAV controller 202 (e.g., of the balancing function). In some embodiments, each VAV controller 202 can send an indication to the computing device 236 that an airflow set point has been reached to the computing device 236 in response to a communication connection established with the computing device 236.

For example, after sending the balancing command to the one or more VAV controllers 202, the computing device 236 can disconnect from the network. The disconnection can be intentional and/or accidental. However, with or without the communication connection between the computing device 236 and the VAV controller, the VAV controller can continue to perform VAV balancing (e.g., perform the balancing function) and can maintain a current balancing state.

By removing the need to keep the VAV balancing instructions connected with the VAV controllers 202 and/or the network, the computing device 236 performing the VAV balancing instructions can use the time that the particular VAV controllers are performing VAV balancing to begin VAV balancing in another part of the structure. Alternatively and/or in addition, the computing device 236 can be used to perform other functions, that may or may not be related to VAV balancing, during the time.

Upon establishing a communication connection between the computing device 236 and the one or more VAV controllers 202 performing VAV balancing (e.g., reestablishing a communication connection to the network), the VAV controllers can send an indication to the computing device 236 of the current balancing state. For example, a VAV controller can send an indication that an airflow set point is reached and/or that airflow is stable. In response to the indication that the airflow set point is reached, the computing device 236 can send a command to the VAV controller to end VAV balancing.

In some embodiments, the computing device 236 can provide a visual and/or audio indication that the airflow set point is reached on a user interface of the computing device 236. A user can, in response to the visual and/or audio indication, measure airflow of the VAV box and input (e.g., either by typing or using voice commands) the measured airflow data to the computing device 236. The computing device 236 can send the measured airflow data to the particular VAV controller to complete the VAV balancing process.

For example, the particular VAV controller can receive the measured airflow data (sent) from the computing device 236 and can compare the measured airflow data to sensed airflow data to calibrate the VAV controller for VAV balancing. The calibration can include an error ratio of measured airflow to sensed airflow that can be subsequently used by the VAV controller.

The computing device 236 and/or mobile device 232, in some embodiments, can group the plurality of VAV controllers 202 into a number of groups. Each of the number of groups can include a subset of the plurality of VAV controller 202.

Further, the subset of the plurality of VAV controllers in a group can perform VAV balancing concurrently. Concurrently performing VAV balancing can include at the same time and/or sequentially (e.g., a first portion of the subset can start performing and a second portion of the subset can begin after the first portion reaches a set point or fails).

The VAV controllers can be grouped based on zones of the structure, types of VAV controllers, order that airflow is received in the structure, and/or random, among other groupings. For example, in some embodiments, the computing device 236 performing the VAV balancing instructions can illustrate (e.g., display) VAV controllers 202 in the structure or zone in the order that airflow is received in the structure or zone from an air handling unit (AHU). The VAV balancing can occur in the order that the airflow is received in the structure.

An AHU, as used herein, can include a device used to regulate and circulate air as part of the VAV system. The AHU can supply airflow to the duct work to which the VAV boxes are connected to.

Alternatively and/or in addition, the computing device 236 and/or mobile device 232 can begin VAV balancing in the plurality of VAV controllers 202 in a random and/or scattered fashion. A random and/or scattered fashion can prevent pressure build up and/damage in the duct work from occurring during the VAV balancing process.

Figure 3:
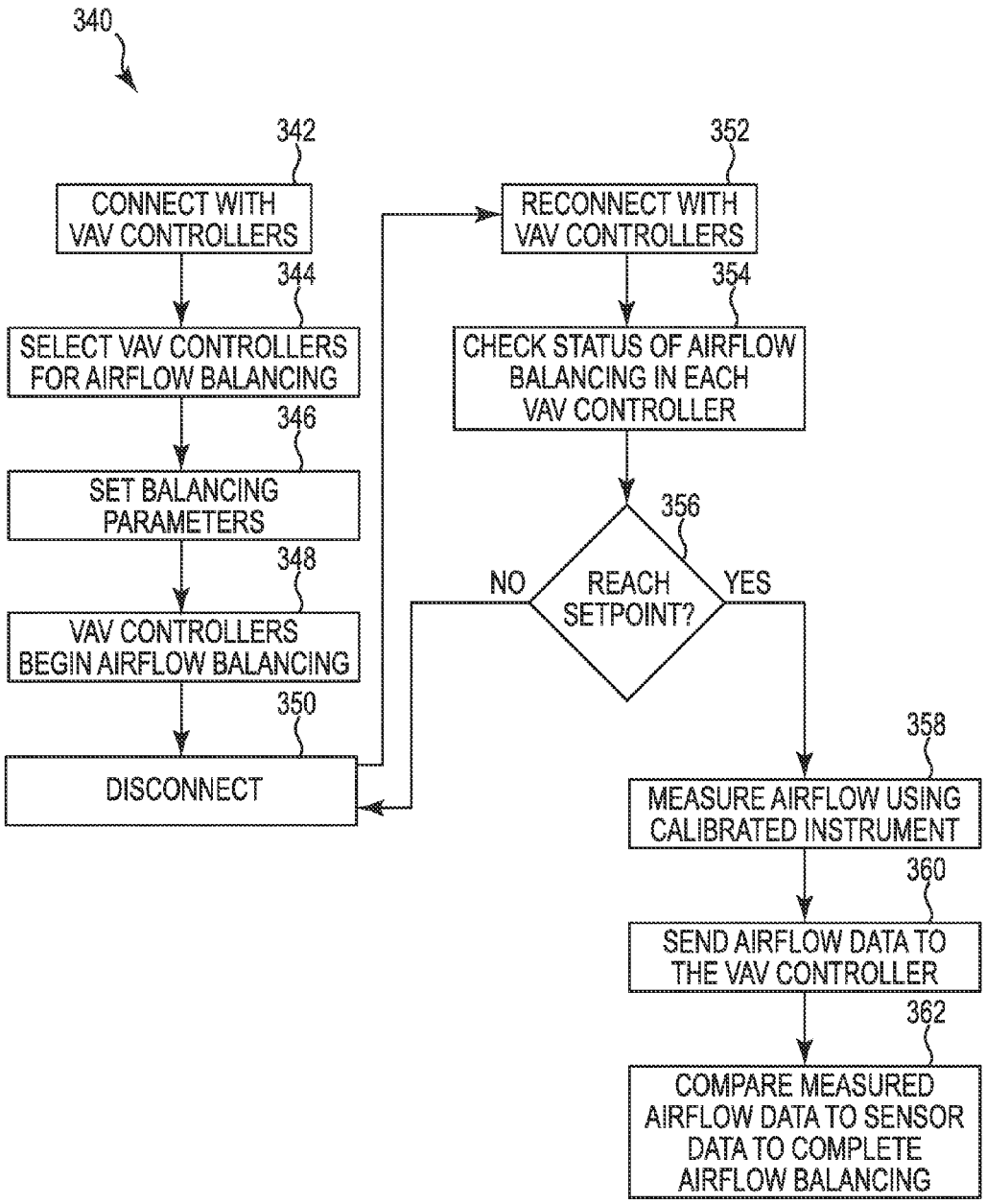
FIG. 3 illustrates an example of a process for VAV balancing in accordance with one or more embodiments of the present disclosure.

FIG. 3 illustrates an example of a process for VAV balancing in accordance with one or more embodiments of the present disclosure. The process 340, as illustrated by FIG. 3, can be performed using one or more VAV controllers, such as the VAV controller 102 illustrated by FIG. 1 and/or the VAV controllers 202 illustrated by FIG. 2, and/or a VAV balancing system, such as the VAV balancing system 230 illustrated by FIG. 2.

At block 342, the process 340 can include a computing device connecting with a plurality of VAV controllers. The computing device can connect to the VAV controllers using a network. For example, the computing device can connect to the VAV controllers using a low bandwidth network router. For example, the low bandwidth network router can include a BACnet router, such as a BACnet/IP to MSTP router, to establish a communication connection. MSTP can include the low bandwidth technology, for example.

At block 344, one or more VAV controllers among the plurality can be selected for VAV balancing. For example, the computing device can group the plurality of VAV controllers into a number of groups and can select one of the number of groups for VAV balancing.

The computing device (performing VAV balancing instructions), at block 346, can set balancing parameters for the selected one or more VAV controllers. Balancing parameters, as used herein, can include parameters related to balancing airflow. For example, balancing parameters can include a duct parameter and/or a set point, among other parameters.

A duct parameter, as used herein, can include a value associated with the duct. For instance, a size, length, and/or area of the duct can be specified and the VAV controller can be balanced accordingly.

A set point can include an airflow set point. An airflow set point, as previously discussed, can include a particular volume of airflow per period of time.

In some embodiments, a plurality of set points can be used. For instance, the airflow set point can include a zero set point (e.g., the damper is closed, providing no airflow), a minimum set point (e.g., the damper is set to a position that provides a threshold minimum airflow), and/or a maximum set point (e.g., the damper is fully open, providing a threshold maximum airflow). The damper motor can be driven to reach the one or more of the airflow set points by the VAV controller, for example.

At block 348, the one or more selected VAV controllers can begin VAV balancing. For example, the one or more VAV controllers can perform VAV balancing using a balancing function in response to the command from the computing device to begin VAV balancing. Upon beginning the VAV balancing, each of the one or more VAV controllers or the computing device can start a counter to indicate an elapsed time since the start of the balancing function, as previous discussed.

The VAV balancing can be performed independently from the computing device. For example, as illustrated by the embodiment of FIG. 3, at block 350, the computing device can disconnect from the network and/or the plurality of VAV controllers.

The computing device can be used to perform other functions, as previously discussed, and/or the VAV balancing can be completed by a different user. For instance, if a shift change occurs in the middle of the VAV balancing process, the process can continue during the change and the different user can complete the process.

In some embodiments, upon initiating the disconnection from the network, the VAV balancing instructions being performed by the computing device can request that a user of the computing device confirm the VAV balancing process continues. The user can provide a confirmation to continue the VAV balancing when the computing device disconnects and/or can indicate the VAV balancing should discontinue.

At block 352, the computing device performing the VAV balancing instructions can reconnect with the VAV controllers and/or the network. The computing device, at block 354, can check a status of the VAV balancing of the one or more selected VAV controllers.

For example, each selected VAV controller can send a current balancing state to the computing device in response to the reconnection of the communication connection between the VAV controllers and the computing device. Each of the selected VAV controllers can maintain a current balancing state of the VAV controllers (e.g., of the balancing function). For example, the selected VAV controllers can send an indication to the computing device that an airflow set point is reached in response to a communication connection established with the computing device.

The computing device, at block 356, can determine if one or more of the selected VAV controllers has reached an airflow set point. In response to determining none of the selected VAV controllers has reached an airflow set point, the computing device can disconnect from the network (at block 350).

In response to determining one or more of the selected VAV controllers has reached an airflow set point, at block 358, airflow of the VAV box associated with the VAV controller can be measured using a calibrated instrument.

The computing device can, for instance, provide an indication on a user interface that the set point is reached. In response the indication, a user can measure the airflow and input measured airflow data to the computing device.

At block 360, the measured airflow data can be sent to the VAV controller. The measured airflow data received by the VAV controller from the computing device, at block 362, can be compared to sensed airflow data to calibrate the VAV controller for VAV balancing, as previously discussed.

Figure 4:
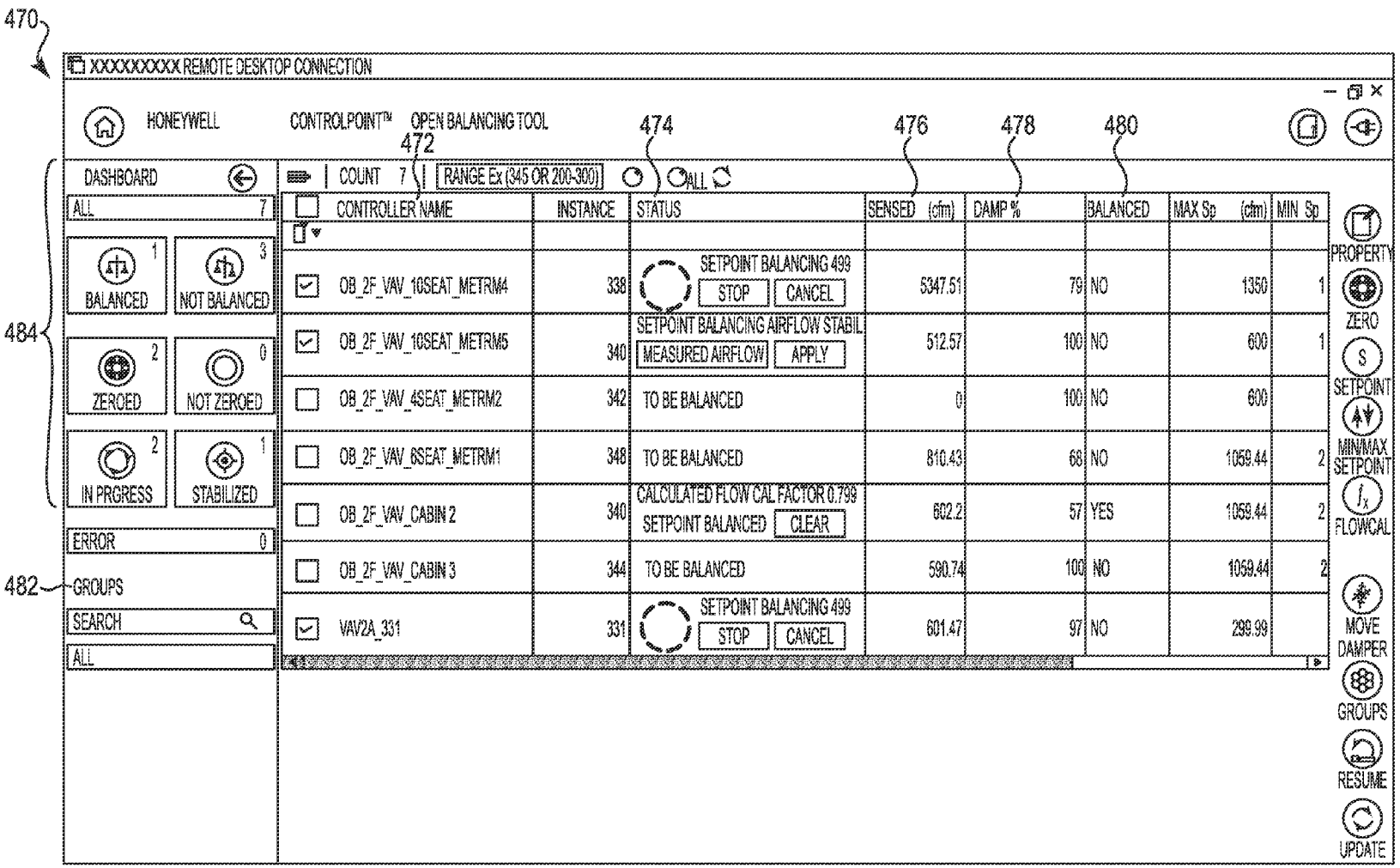
FIG. 4 illustrates an example of a user interface for VAV balancing in accordance with one or more embodiments of the present disclosure.

FIG. 4 illustrates an example of a user interface for VAV balancing in accordance with one or more embodiments of the present disclosure. The user interface 470 illustrated by FIG. 4 can be provided on a display of a computing device performing VAV balancing instructions, such as the computing device 236 illustrated by FIG. 2, in some embodiments.

The user interface 470 can include a display of the VAV balancing instructions (e.g., software/program). As illustrated by FIG. 4, the user interface 470 can include a display of a current balancing state of all VAV controllers in the structure 484 and/or in a particular group. Further, the user interface 470 includes an icon and/or other link to view the number of groups 482 of VAV controllers in a structure.

The user interface 470 as illustrated by FIG. 4 can include a display of a current balancing state of a subset of VAV controllers. The subset of VAV controllers can include a group of VAV controllers, VAV controllers in a zone, and/or selected VAV controllers. For example, in some embodiments, each of the subset of VAV controllers can be currently selected for VAV balancing and/or a portion of the subset of VAV controllers can be currently selected for VAV balancing.

In accordance with some embodiments of the present disclosure, each of the plurality of VAV controllers can have a unique identification (id). For example, a user can persist a human friendly unique id for each of the plurality of VAV controllers in the structure and/or each selected VAV controller. The unique id can be illustrated on the user interface 470 as a controller name 472.

The user interface 470 can further include a display of the status of VAV balancing 474, sensed airflow 476, damper percentage 478, balanced status 480, among other information (such as maximum airflow set point, minimum airflow set point, etc.) The status of VAV balancing 474 displayed can include a current balancing state of each of the displayed VAV controllers.

Sensed airflow 476 can include an airflow sensed using an airflow sensor in the VAV box. A damper percentage 478 can include a damper position. A balanced status 480 can include an indication if a VAV controller that has calculated an error ratio or not.

The user interface 470, as illustrated by FIG. 4, can provide a human friendly view of the current status of VAV balancing in a structure that a user can understand. For example, a user can view a list of VAV controllers that are in-progress of VAV balancing, a time when the VAV balancing began, and/or what user triggered the start of the VAV balancing.

In some embodiments, the display can assist a user in identifying VAV balancing issues. For example, the user interface 470 can provide a display of the maximum airflow measured. The user can compare the maximum airflow measured to an airflow set point (e.g., a maximum airflow set point) and identify that that maximum airflow measured is less than the airflow set point. The user can inspect the sensed airflow, the airflow set point, and/or an elapsed time to identify the issue.

For example, the user can stop the VAV balancing performed by the VAV controller to inspect the issue and/or to complete VAV balancing. Alternatively, the user can cancel the VAV balancing and leave the VAV controller unbalanced until the problem related to the maximum measured airflow (e.g., the actual airflow) is addressed.

As used herein, "logic" is an alternative or additional processing resource to execute the actions and/or functions, etc., described herein, which includes hardware (e.g., various forms of transistor logic, application specific integrated circuits (ASICs), etc.), as opposed to computer executable instructions (e.g., software, firmware, etc.) stored in memory and executable by a processor.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of some embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of some embodiments of the disclosure includes any other applications in which the above structures and methods are used. Therefore, the scope of some embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for variable airflow volume balancing, comprising:

receiving, by a variable airflow volume controller, a command from a computing device to begin variable airflow volume balancing;

performing a balancing function using the variable airflow volume controller in response to the command, wherein the command is performed independent of the computing device;

storing a start time to begin performing the balancing function;

starting a counter to indicate an elapsed time of the balancing function;

ending the balancing function in response to the counter reaching or exceeding a threshold elapsed time; and compare measured airflow data to sensed airflow data to data to calibrate the variable airflow volume controller.

2. The method of claim 1, including receiving, by the variable airflow volume controller from the computing device, an additional command to end the balancing function.

3. The method of claim 1, including receiving an airflow set point from the computing device.

4. The method of claim 1, including maintaining a current balancing state independent of the computing device.

5. The method of claim 1, including storing a current balancing state of a reached set point in response to reaching an airflow set point.

6. The method of claim 1, including restarting performance of the balancing function in response to a power cycle affecting the variable airflow volume controller.

7. The method of claim 1, including sending an indication to the computing device indicating a current balancing state in response to a connection of communication between the variable airflow volume controller and the computing device.

8. A variable airflow volume controller, comprising:

a computing component configured to:

perform a balancing function in response to a command from a computing device to begin variable airflow volume balancing, wherein the balancing function is performed independent of the computing device;

track an elapsed time of the balancing function;

maintain a current balancing state of the balancing function;

send the current balancing state to the computing device in response to a communication connection between the variable airflow volume controller and the computing device; and compare measured airflow data to sensed airflow data to calibrate the variable airflow volume controller.

9. The variable airflow volume controller of claim 8, wherein the balancing function is based on a proximity of a current sensed airflow of a variable airflow volume box associated with the variable airflow volume controller to an airflow set point and the elapsed time of the balancing function.

10. The variable airflow volume controller of claim 8, wherein the balancing function is stored as firmware on the variable airflow volume controller.

11. The variable airflow volume controller of claim 8, wherein the computing component is configured to receive the balancing function from the computing device.

12. A variable airflow volume balancing system, comprising:

a computing device configured to communicate with a plurality of variable airflow volume controllers;

at least one router configured to provide a communication interface between the computing device and the plurality of variable airflow volume controllers; and the plurality of variable airflow volume controllers, wherein each of the plurality of variable airflow volume controllers is configured to:

receive a balancing command from the computing device to begin variable airflow volume balancing;

perform a balancing function independent of the computing device in response to receiving the balancing command;

restart performance of the balancing function in response to a power cycle affecting the variable airflow volume controller;

send an indication to the computing device that an airflow set point is reached in response to a communication connection established with the computing device;

receive measured airflow data from the computing device in response to the indication; and compare the measured airflow data to sensed airflow data to calibrate the variable airflow volume controller; and wherein the computing device is configured to send a command to end variable airflow volume balancing in response to the indication that the airflow set point is reached.

13. The variable airflow volume balancing system of claim 12, wherein the computing device is configured to send the balancing command to a subset of the plurality of variable airflow volume controllers to begin variable airflow volume balancing and wherein each of the subset performs the balancing function independent of the computing device.

14. The variable airflow volume balancing system of claim 13, wherein the each variable airflow volume controller in the subset maintains a current balancing state of the balancing function.

15. The variable airflow volume balancing system of claim 12, wherein the at least one router includes a building automation and control network (BACnet) router connected to at least a subset of the plurality of variable airflow volume controllers.

16. The variable airflow volume system of claim 12, wherein the computing device is configured to group the plurality of variable airflow volume controllers into a number of groups and wherein a subset of the plurality of variable airflow volume controllers in each group is configured to perform the balancing function concurrently.

* * * * *